US006350159B1

(12) United States Patent
Wu

(10) Patent No.: US 6,350,159 B1
(45) Date of Patent: Feb. 26, 2002

(54) ARRANGEMENT FOR PREVENTING MISMATING OF CONNECTORS HAVING DIFFERENT NUMBERS OF TERMINALS

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/664,877

(22) Filed: Sep. 19, 2000

(51) Int. Cl.[7] ..... H01R 13/64
(52) U.S. Cl. ..... 439/680; 439/358
(58) Field of Search ..... 439/358, 357, 439/680, 681

(56) References Cited

U.S. PATENT DOCUMENTS

| | | | | |
|---|---|---|---|---|
| 4,979,910 A | * | 12/1990 | Revil et al. | 439/358 |
| 5,380,217 A | * | 1/1995 | Yagie et al. | 439/358 |
| 5,425,650 A | * | 6/1995 | Maeda | 439/680 |
| 5,613,881 A | * | 3/1997 | Ichida et al. | 439/680 |
| 6,183,287 B1 | * | 2/2001 | Po | 439/358 |

* cited by examiner

*Primary Examiner*—Gary F. Pauman
*Assistant Examiner*—James R. Harvey
(74) *Attorney, Agent, or Firm*—Wei Te Chung

(57) ABSTRACT

An electrical connector system prevents mismating of male and female connectors which have different numbers of terminals. An illustrative electrical connector assembly (1, 3) of this system includes a male connector (10, 30) and a female connector (20, 40) complementary to the male connector. The male connector includes an insulative housing (12, 32) forming a plurality of silos (14, 34) thereon and a latch (16, 36) on a top side thereof. The female connector (20, 40) includes an insulative housing (22, 42) having a corresponding number of receptacles (24, 44) therethrough for receiving the silos of the male connector, and a latch lug (26, 46) for engaging with the latch of the male connector. The female connector further includes a pair of blocks (21, 41) disposed adjacent to two opposite sides of the latch lug. Electrical connector assemblies having different numbers of terminals have latches, latch lugs and blocks offset from those of other assemblies in the system. Thus, latches on male connectors are blocked from latching with latch lugs of non-complementary female connectors by the blocks of the non-complementary female connectors.

5 Claims, 7 Drawing Sheets

ARRANGEMENT FOR PREVENTING MISMATING OF CONNECTORS HAVING DIFFERENT NUMBERS OF TERMINALS

BACKGROUND OF THE INVENTION

1. Field of the Invention

The present invention relates to electrical connectors, and particularly to an arrangement for preventing mismating of electrical connectors with different numbers of terminals.

2. Description of the Related Art

Electrical connector assemblies are provided in a wide variety of configurations and generally are provided in sets (i.e. pairs) of connectors, such as male and female connectors, which are used to interconnect terminating ends of electrical circuitry. The connector assemblies mount a plurality of terminals or contacts which interengage when the male and female connectors are mated. Most often, the terminals or contacts are terminated to discrete wires or to circuit traces on a printed circuit board, a combination of which must be properly interconnected. For instance, in hard wired circuitry, a "hot" wire must be interconnected with a corresponding hot wire, a neutral wire must be interconnected with a corresponding neutral wire and a ground wire must be interconnected with a corresponding ground wire. In certain electronic applications, various signal circuitry must be properly interconnected with corresponding signal circuitry through the mating connectors. Consequently, it has been common to polarize a set or pair of mating electrical connectors so that they can be mated in only one orientation in order to properly polarize the electrical wiring or circuitry therethrough.

In order to properly understand the invention herein, the telex "polarization" is understood to define structures whereby a single set or pair of electrical connectors can be mated in only one orientation as described above, such as in only one of two 180° orientations. The term "keying", on the other hand, is meant to describe a system wherein one connector of any given set or pair thereof cannot be mated with another connector of another set or pair thereof, regardless of orientation.

Heretofore, there have been a variety of different polarization schemes or structures. For instance, a set or pair of electrical connectors may have keys and slots or other shapes on the outside surfaces of the connectors so that the connectors can be polarized and mated in only one of two 180° orientations. Another scheme utilizes silos projecting from a connector housing and within which the terminals or contacts are mounted. The silos are received in receptacles of the mating connector. The silos and receptacles have a particular cross-sectional shape which allow the connectors to mate in only one of two 180° orientations.

However, there are electrical connector systems wherein a plurality of sets or pairs of mating electrical connectors of corresponding connector assemblies are provided of similar configurations, such as generally rectangular configurations, and wherein each set of connectors mounts a different number of pairs of terminals or contacts. In such systems, although the connectors in any given set thereof are polarized in order to ensure proper mating, there is a danger that one connector of any given set will be mated with a connector of a different set, especially when outer sizes of them are substantially compatible. In other words, one set or pair of mating connectors may have only one pair of terminals or contacts. That set of connectors would interconnect two circuits. Another set of mating connectors may have two pairs of terminals for interconnecting four circuits.

The sets of connectors may increase in "size" to include three pairs of terminals for interconnecting six circuits, four pairs of terminals for interconnecting eight circuits, and so on. In other words, the size of the connectors are determined by the number of interconnected circuits, and such connectors are manufactured, sold and/or made available in the connector industry as an identifiable "Series" or "Line" of electrical connectors. There is a need for providing a keying system for such electrical connector systems whereby a connector in any given set thereof cannot be mated with an opposite connector in any other set thereof having a larger number of pairs of terminals. In other words, there could be serious problems if a smaller sized connector would be connected inadvertently or erroneously to a larger sized connector.

Problems are encountered in attempting to employ keying schemes to the electrical connector assemblies described immediately above, particularly wherein the plurality of sets of connectors in the electrical connector systems employ silos and receptacles at the mating interface between the connectors in each set. These problems arise particularly in high density and/or miniaturized electrical connectors, wherein the terminals are very closely spaced in a compact array. In such circumstances, it is difficult to provide keying structures on the silos and/or in the receptacles because the walls thereof are very thin. This invention is directed to solving the problems described above by providing a unique keying system for sets of electrical connectors which use silos and receptacles at their mating interfaces. The solution provided by this invention is hereinafter referred to as an arrangement for preventing mismating.

SUMMARY OF THE INVENTION

An object, therefore, of the invention is to provide a new and improved arrangement (keying system) for an electrical connector system for preventing mismating between electrical connectors of the connector system having different numbers of terminals.

An electrical connector system in accordance with the present invention comprises a plurality of pairs of male and female connectors, the male and female connectors being exclusively engageable only with complementary female and male connectors. The mating male and female connectors comprise corresponding numbers of complementary electrical terminals for engaging with each other, an engageable latch and latch lug for securing a mating interface therebetween, and a pair of blocks cooperating with the latch to prevent mismating when a male/female connector having a different number of terminals is erroneously or inadvertently mated with the female/male connector.

Other objects, advantages and novel features of the invention will become more apparent from the following detailed description of the present embodiment when taken in conjunction with the accompanying drawings.

DETAILED DESCRIPTION OF THE INVENTION

Figure 1:
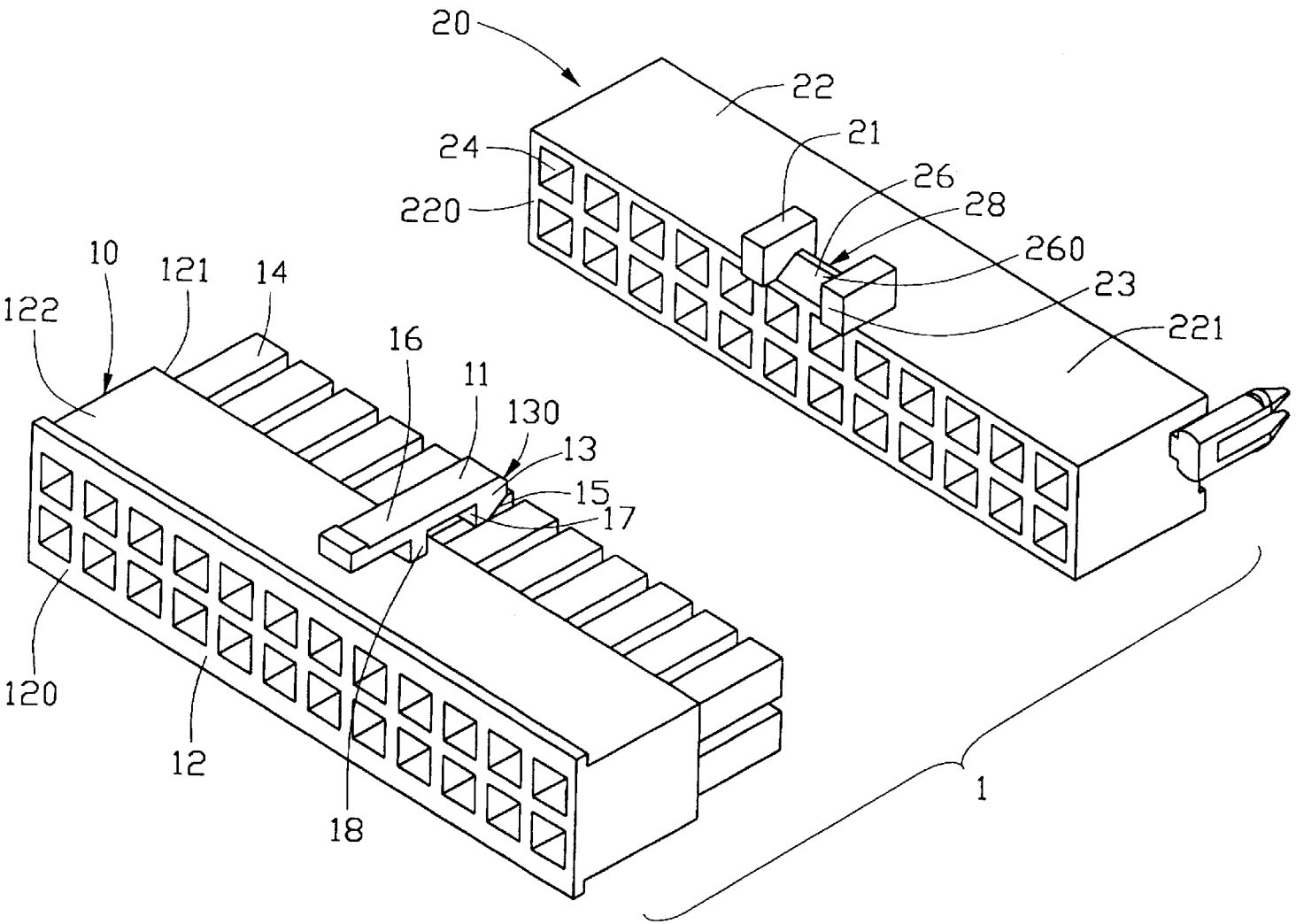
FIG. 1 is a perspective view of a connector assembly in accordance with the present invention, with a male connector and a female connector of the connector assembly being not mated with each other.

Referring to FIG. 1 an electrical connector assembly 1 in accordance with the present invention comprises a male connector 10 and a female connector 20 complementary to the male connector 10.

The male connector 10 comprises an elongated insulative housing 12. The insulative housing 12 comprises an elongated base portion 120 defining a male mating face 121 and a male top face 122 thereon, a plurality of silos 14 protruding forward from the male mating face 121, and a latch 16 formed on the male top face 122. The silos 14 are arranged in an upper row and a lower row and the number of the silos 14 in the upper row is equal to that of the silos 14 in the lower row. Each silo 14 accommodates a receptacle terminal (not shown) therein. The structure of the receptacle terminal is conventional. The latch 16 is disposed at a substantially central position along a longitudinal direction of the male top face 122 but is offset in the longitudinal direction of the housing 12 from the silos 14 thereunder. The latch 16 comprises a body portion 11 and a support portion 18 supporting the body portion 11 on the male top face 122 of the base portion 120. The body portion 11 extends in a direction parallel to a direction along which the silos 14 extend and comprises a head 13 on a front end thereof. The head 13 extends beyond the male mating face 121 of the base portion 120 and above the silos 14. The head 13 comprises an abutment section 130 on a forward edge thereof, an inclined section 15 extending backward and downward from the abutment section 130 and a vertical locking section 17 extending perpendicular to the direction the body portion 11 extends.

The female connector 20 comprises an elongated insulative housing 22 defining a female mating face 220 and a female top face 221 thereon. The housing 22 comprises a plurality of receptacles 24 therein extending from the female mating face 220. The receptacles 24 are arranged in an upper row and a lower row. The number of receptacles 24 in the upper row is equal to that of the receptacles 24 in the lower row and is also equal to that of the silos 14 in the upper or lower rows of the male connector 10. Each receptacle 24 receives a plug terminal (not shown) therein. The structure of the plug terminal is conventional. The housing 22 forms a latch lug 26 on the female top face 221 thereof and a pair of blocks 21 disposed adjacent to two opposite sides of the latch lug 26. The latch lug 26 is disposed in substantially a central position along a longitudinal direction of the insulative housing 22 corresponding to the latch 16 of the male connector 10. The latch lug 26 defines an inclined face 260 and a vertical engaging face 28 thereon. The inclined face 260 gradually declines from a rear and top portion to a front portion of the latch lug 26 and terminates at a top edge of the female mating face 220. The blocks 21 are generally rectangular and each block 21 defines a stopping face 23 thereon. The blocks 21 protrude forward from the female top face 221 with the stopping faces 23 projecting beyond the female mating face 220.

Figure 3:
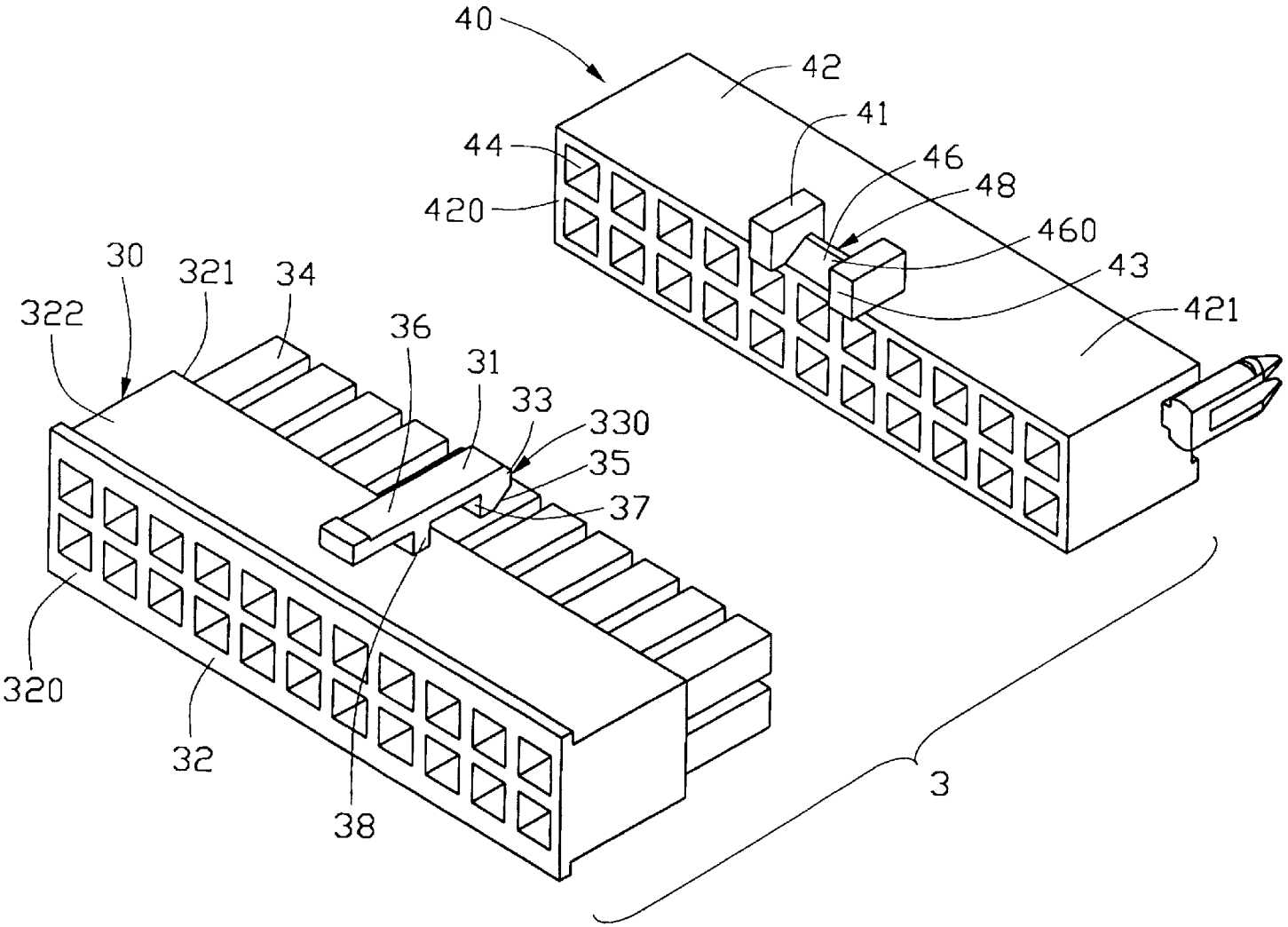
FIG. 3 is a view similar to FIG. 1 but showing a connector assembly having a male and a complementary female connectors, wherein the number of the terminals of each connector shown different from that of the connector assembly shown FIG. 1.

Referring to FIG. 3, a connector assembly 3 in accordance with the present invention comprises a male connector 30 and a female connector 40 complementary to the male connector 30. The male connector 30 is similar in structure to the male connector 10 and comprises an elongated insulative to housing 32. The insulative housing 32 comprises an elongated base portion 320 defining a male mating face 321 and a male top face 322 thereon, a plurality of silos 34 protruding forward from the male mating face 321, and a latch 36 formed on the male top face 322. The silos 34 are arranged in an upper row and a lower row. The number of silos 34 in the upper row is equal to that of the silos 34 in the lower row, and is one less than the number of silos 14 in the upper/lower rows of the male connector 10. Each silo 34 accommodates a receptacle terminal (not shown) therein. The latch 36 is disposed at a substantially central position along a longitudinal direction of the base portion 320 and is aligned with one of the silos 34. The latch 36 comprises a body portion 31 and a support portion 38 defining a distance between the body portion 31 and the base portion 320. The body portion 31 extends in a direction parallel to a direction along which the silos 34 extend and comprises a head 33 on a front end thereof. The head 33 extends beyond the male mating face 321 of the base portion 320 and above the silos 34. The head 33 comprises an abutment section 330 on a forward edge thereof, an inclined section 35 extending backward and downward from the abutment section 330 and a vertical locking section 37 extending in a direction perpendicular to the direction the body portion 31 extends.

The female connector 40 is similar in structure to the female connector 20 and comprises an elongated insulative housing 42 defining a female mating face 420 and a female top face 421 thereon. The housing 42 comprises a plurality of receptacles 44 therein extending from the female mating face 420. The receptacles 44 are arranged in an upper row and a lower row. The number of receptacles 44 in the upper row is equal to that of the receptacles 44 in the lower row, and is one less than that of the receptacles 24 in the upper/lower rows of the female connector 20. Each receptacle 44 receives a plug terminal (not shown) therein. The housing 42 forms a latch lug 46 on the female top face 421 thereof and a pair of blocks 41 disposed adjacent to two opposite sides of the latch lug 46. The latch lug 46 is positioned between the blocks 41 and, in particular, is spaced an equal distance from each of the blocks 41. The blocks 41 are spaced from each other a distance generally equal to the width of the latch 36. The latch lug 46 is aligned with one of the receptacles 44 corresponding to the silo 34 aligned with the latch 36 and is disposed in substantially a central position along a longitudinal direction of the insulative housing 42. The latch lug 46 defines an inclined face 460 and a vertical engaging face 48 thereon. The inclined face 460 declines gradually from a rear top portion to a front portion of the latch lug 46 and terminates at a top edge of the female mating face 420. The blocks 41 are (generally rectangular and each block 41 defines a stoppling face 43 thereon. The blocks 41 protrude forward from the female top face 421 with the stopping faces 43 projecting beyond the female mating face 420.

Figure 2:
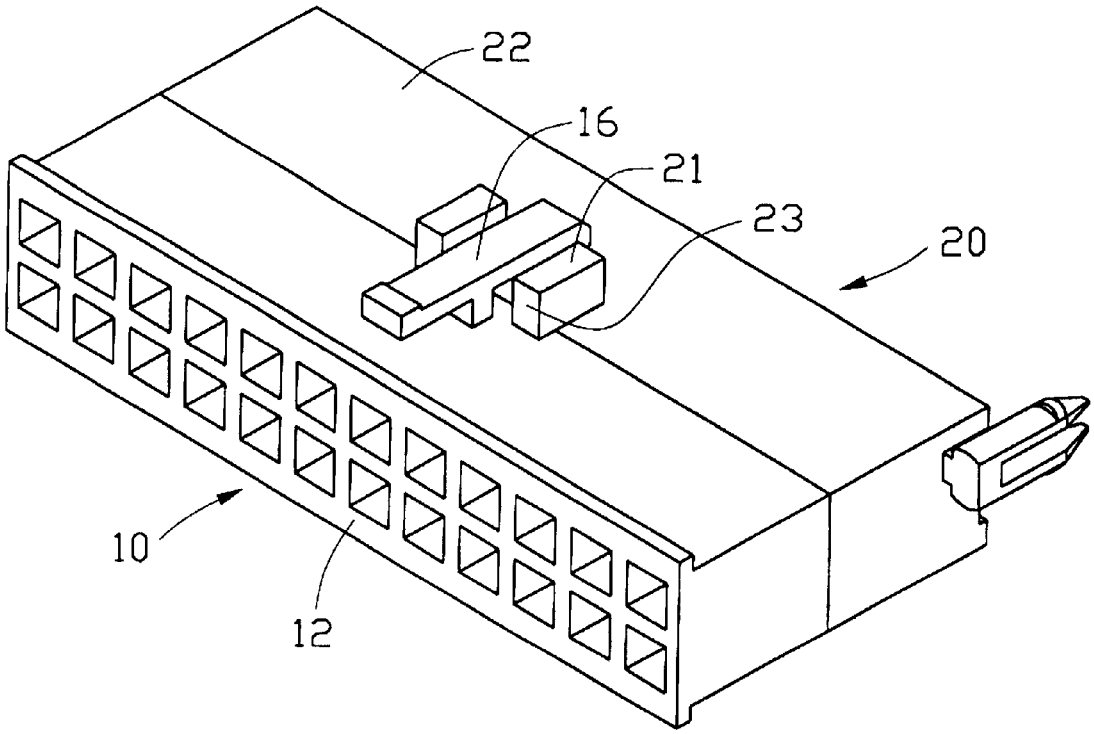
FIG. 2 is a perspective view showing the male and female connectors of the connector assembly of FIG. 1 being in a mated condition with each other.
Figure 4:
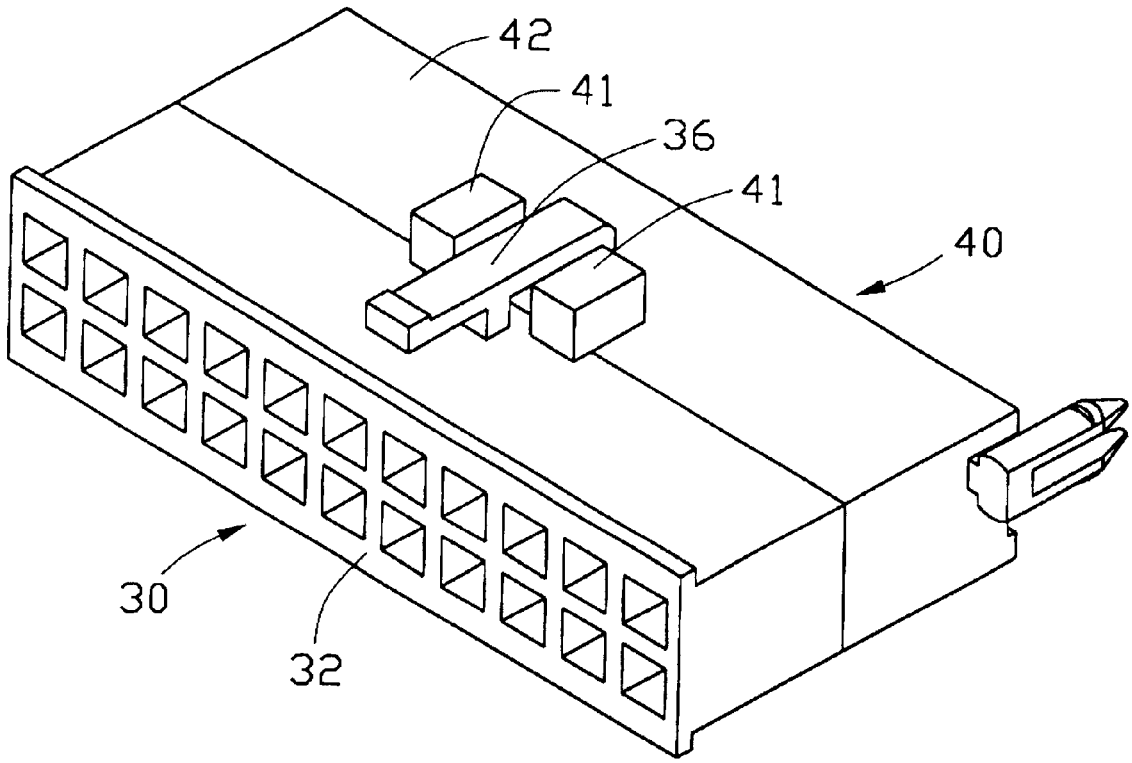
FIG. 4 is a perspective view showing the male and female connectors of the connector assembly of FIG. 3 being mated with each other.
Figure 5:
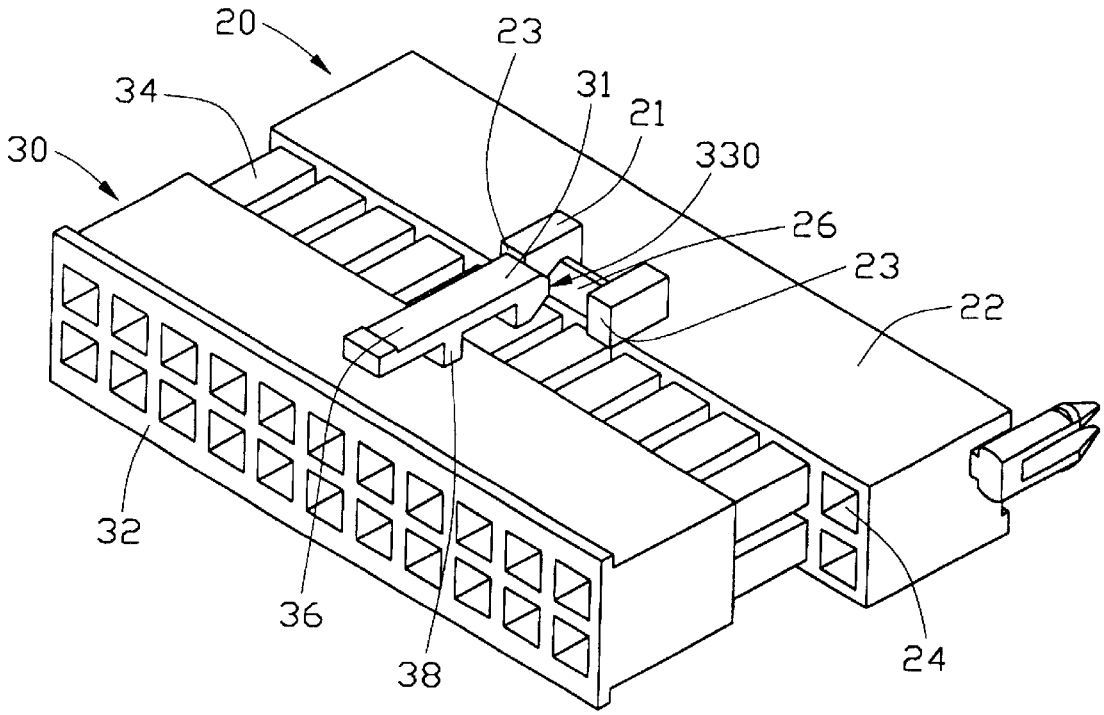
FIG. 5 is a perspective view showing the male connector of FIG. 3 in an attempt to mate with the female connector of FIG. 1.
Figure 6:
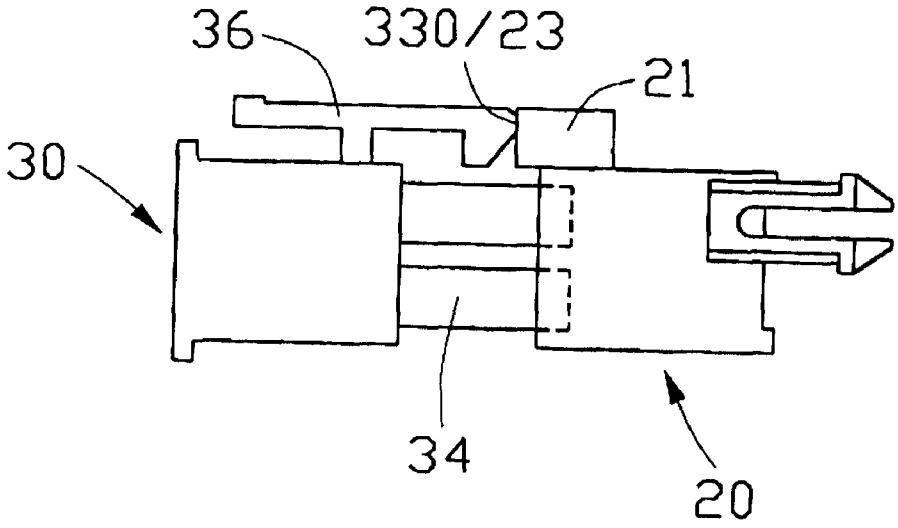
FIG. 6 is a side elevational view of FIG. 5.
Figure 8:
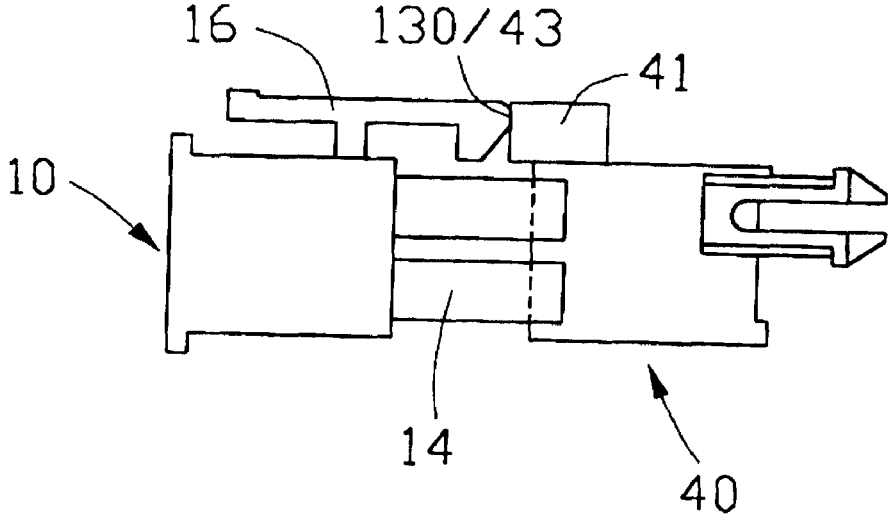
FIG. 8 is a side elevational view of FIG. 7.
Figure 7:
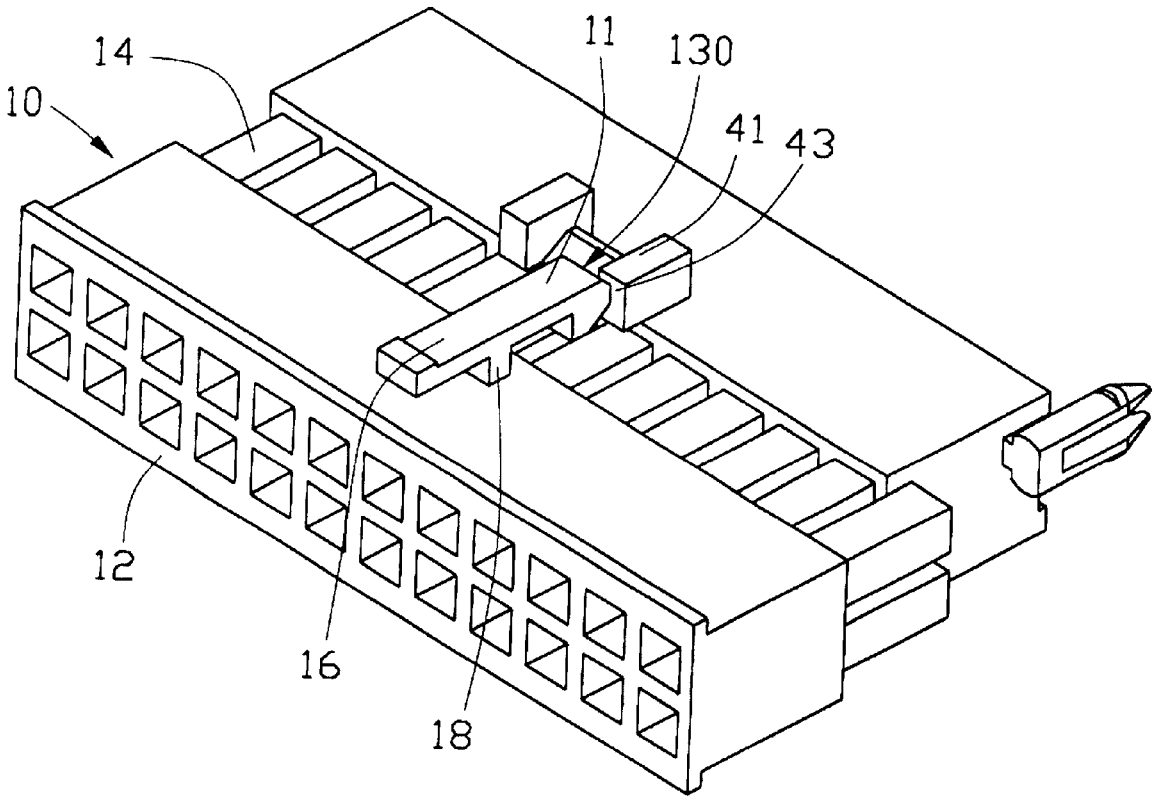
FIG. 7 is a perspective view showing the male connector of FIG. 1 in an attempt to mate with the female connector of FIG. 3.

Referring to FIGS. 2 and 4, in use, the silos 14, 34 are received by the receptacles 24, 44, respectively, to respectively engage the receptacle terminals in the silos 14, 34 with the plug terminals in the receptacles 24, 44. The male mating faces 121, 321 abut against the female mating faces 220, 420, respectively. The inclined sections 15, 35 slide along the inclined faces 260, 460 between the blocks 21, 41 to guide the vertical locking sections 17, 37 to abut against the vertical engaging faces 28, 48, respectively. Proper electrical connections between the male and female connectors 10, 30, 20 and 40 are achieved due to their corresponding numbers of silos and receptacles and the corresponding locations of the latch lugs 26, 46 and the blocks 21, 41 on the female top faces 221, 421 and of the latches 16, 36 on the male top faces 122, 322.

Referring to FIGS. 5–8, when the male connector 30 is inadvertently used in an attempted mating with the female connector 20 or when the male connector 10 is inadvertently used in an attempted mating with the female connector 40, either periphery of the receptacles 24/44 would stop the silos 34/14 or the stopping faces 23, 43 of corresponding blocks 21, 41 would stop the abutment sections 330, 130 of the latches 36, 16. Therefore, the male connector 30, 10 would be unable to properly mate with the female connector 20, 40. A keying function which prevents mismating between the male and female connectors 10, 20, 30, 40 is thus achieved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first electrical connector comprising an insulative housing, the insulative housing comprising a plurality of silos protruding forward therefrom and a latch formed thereon; and a second electrical connector comprising an insulative housing, the insulative housing of the second electrical connector comprising a plurality of receptacles defined therethrough and a latch lug formed thereon to engage with the latch of the first electrical connector, a number of the receptacles being equal to a number of the silos of the first electrical connector and each receptacle receiving one silo of the first electrical connector, the insulative housing of the second electrical connector forming a first block thereon to stop a latch of a third electrical connector similar in structure to the first electrical connector and having silos of a number different from the number of the silos of the first electrical connector to prevent a mating between the second and the third electrical connectors;

wherein the latch of the first or the third connector comprises an abutment section on a front end thereof and the first block comprises a stopping face for abutting with the abutment section of the latch of the third connector;

wherein the first block is disposed beside one side of the latch lug;

wherein a second block is formed beside a side of the latch lug opposite to the side where the first block is disposed, both the first and second blocks extending forwardly beyond the rest of the second connector;

wherein the silos of the first electrical connector are arranged in a plurality of rows and the receptacles of the second electrical connector are arranged in a corresponding number of rows, a number of the silos in one row being equal to a number of the silos in an other row and a number of the receptacles in one corresponding row being equal to a number of the receptacles in an other.

2. The electrical connector assembly as claimed in claim 1, wherein the silos of the third electrical connector are arranged in a plurality of rows and a number of the silos in one row is equal to a number of the silo in an other row and is less than the number of the silos in the one row of the first electrical connector.

3. The electrical connector assembly as claimed in claim 1, wherein the silos of the third electrical connector are arranged in a plurality of rows and a number of the silos in one row is equal to a number of the silo in an other row and is one less than the number of the silos in the one row of the first electrical connector.

4. The electrical connector assembly as claimed in claim 1, wherein the silos of the third electrical connector are arranged in a plurality of rows and a number of the silos in one row is equal to a number of the silo in an other row and is more than the number of the silos in the one row of the first electrical connector.

5. The electrical connector assembly as claimed in claim 1, wherein the silos of the third electrical connector are arranged in a plurality of rows and a number of the silos in one row is equal to a number of the silos in an other row and is one more than the number of the silos in the one row of the first electrical connector.

* * * * *